US005603302A

United States Patent [19]

Minagawa et al.

[11] Patent Number: 5,603,302

[45] Date of Patent: Feb. 18, 1997

[54] FUEL SUPPLY SYSTEM FOR INTERNAL COMBUSTION ENGINE

[75] Inventors: Kazuji Minagawa, Tokoname; Takashi Akiba, Kariya; Yoshitaka Wakamatsu, Anjo, all of Japan

[73] Assignee: Nippondenso Co., Ltd., Kariya, Japan

[21] Appl. No.: 511,622

[22] Filed: Aug. 7, 1995

[30] Foreign Application Priority Data

Aug. 25, 1994 [JP] Japan ..... 6-200605
Jun. 7, 1995 [JP] Japan ..... 7-140465

[51] Int. Cl.[6] ..... F02M 37/20; F02M 41/00

[52] U.S. Cl. ..... 123/456; 123/510

[58] Field of Search ..... 123/456, 458, 123/461, 510, 511, 516, 468, 469

[56] References Cited

U.S. PATENT DOCUMENTS

| | | | |
|---|---|---|---|
| 5,263,459 | 11/1993 | Talaski | 123/516 |
| 5,327,872 | 7/1994 | Morikawa | 123/516 |
| 5,329,899 | 7/1994 | Sawert et al. | 123/468 |
| 5,359,976 | 11/1994 | Nakashima et al. | 123/516 |
| 5,361,742 | 11/1994 | Briggs et al. | 123/506 |
| 5,365,906 | 11/1994 | Deweedt | 123/510 |
| 5,373,824 | 12/1994 | Peters et al. | 123/456 |
| 5,398,655 | 3/1995 | Tuckey | 123/514 |
| 5,421,306 | 6/1995 | Talaski | 123/510 |

FOREIGN PATENT DOCUMENTS

| | | |
|---|---|---|
| 58-44477 | 10/1983 | Japan . |
| 62-137379 | 8/1987 | Japan . |
| 63-196471 | 12/1988 | Japan . |

*Primary Examiner*—Thomas N. Moulis
*Attorney, Agent, or Firm*—Cushman, Darby & Cushman IP Group of Pillsbury Madison & Sutro LLP

[57] ABSTRACT

A simple and compact fuel supply system which prevents generation of fuel vapor in a delivery pipe of an engine includes a check valve is disposed at a down stream portion of a fuel pressure relieving member or a fuel pressure regulator to seal the fuel delivery pipe when the engine stops so that the pressure in the delivery pipe increases as fuel vapor is generated and, consequently, generation of the fuel vapor is automatically suppressed. Transmission of a pressure wave from the delivery pipe caused while injectors are operating is prevented by the check valve so that harsh noise, which is otherwise caused by resonant vibration of fuel supply pipes and related members, is suppressed.

19 Claims, 11 Drawing Sheets

FUEL SUPPLY SYSTEM FOR INTERNAL COMBUSTION ENGINE

CROSS REFERENCE TO RELATED APPLICATION

The present application is based on and claims priority from Japanese Patent Applications No. Hei 6-200605 filed on Aug. 25 1994 and No. Hei 7-140465 filed on Jun. 7, 1995, the contents of which are incorporated herein by reference.

BACKGROUND OF THE INVENTION

1. Field of the Invention

The present invention relates to a fuel supply system which includes a fuel delivery valve for an internal combustion engine.

2. Description of the Related Art

Generally, fuel vapor generated in the fuel delivery valve at high temperature is discharged from the fuel delivery pipe through a pressure regulator and a return pipe to a fuel tank. In a device disclosed in Utility Model Unexamined Publication Sho 62-137379, a fuel pipe is connected between an upper portion of the delivery pipe and a pressure regulator to discharge the vapor to the fuel tank without storing in the delivery pipe.

In addition, many devices and systems are proposed to prevent emission of the fuel vapor from the fuel tank which is caused by fuel vapor generated in the delivery pipe and carried to the fuel tank. In other devices only a fuel pipe is connected to the fuel delivery pipe and a fuel-return-pipe is omitted, thereby reducing number of parts and the production cost. If the fuel-return-pipe is omitted, the inside of the delivery pipe is sealed except that it connects through injectors and the fuel pipe.

The conventional devices as described above have the following drawbacks.

First, if the return pipe is omitted from the above structure, the vapor in the delivery pipe has no way to go out and may accumulate in the delivery pipe, decreasing fuel injected into the engine and stopping the engine.

In order to obviate the above-mentioned trouble, U.S. Pat. No. 5,359,976 issued to the assignee of this application proposes a device in which the fuel pipe is disposed above the delivery pipe and connected by a branch pipe to an upper portion of the delivery pipe. All connectors of the injectors extend to locate the inlets of the injectors at upper portions of the delivery pipe so that the fuel vapor is mainly discharged through the branch pipe and the rest of the fuel vapor may discharge from the injectors without storing the vapor in the delivery pipe. However, the above device becomes complicated and large in size.

In order to improve the above device, Japanese Utility Model Unexamined publication Sho 63-196471 discloses a device in which a pressure regulator increases its valve opening pressure when the engine stops. Japanese Utility Model Unexamined Publication Sho 58-44477 discloses a device which has an inlet-passage-cut-valve to maintain the inside pressure of the delivery pipe high, thereby preventing generation of the fuel vapor.

However, these structures are required to have high-pressure-resistive members from the upstream portion of the fuel pump to delivery pipe, resulting in complicated structures.

The above two publications only disclose devices which have the return pipes.

Second, if the fuel-return-pipe is omitted from the conventional devices, pressure waves caused by operation of the injectors are transmitted to the fuel pipe and others from the delivery pipe, thereby causing harsh noise.

SUMMARY OF THE INVENTION

The present invention is made in view of the foregoing problem, and has a primary object of providing an improved fuel supply system for an internal combustion engine which can prevent generation of fuel vapor and harsh noise with a simple and compact structure.

Another object of the present invention is to provide a fuel supply system for an internal combustion engine which includes a check valve connected between a fuel passage and a delivery pipe for interrupting fuel flow from the delivery pipe to the fuel passage. With the above check valve, the fuel-return-pipe can be omitted without a complicated structure.

Another object of the present invention is to provide a fuel supply system which restricts fuel flow from the delivery pipe to the fuel passage, thereby suppressing transmission of pressure waves to the supply passage. The restricting unit may be a valve operating in response to pressure difference between the fuel pump and the delivery pipe, and such valve may be a check valve.

A further object of the present invention is to provide a fuel supply system wherein, in addition to the above structure, a fuel filter is disposed in the fuel passage at an upstream portion of the check valve. As a result, the fuel passage between the fuel tank and the fuel filter is not required to have high pressure resistance.

A further object of the present invention is to provide a fuel supply system, wherein the delivery pipe includes a hollow screw which is fixed to the inlet of the delivery pipe and the check valve is disposed in the hollow screw. Thus, assembling of the device becomes simple.

A further object of the present invention is to provide a fuel supply system with a fuel pressure regulator disposed in the fuel tank for regulating fuel pressure in the delivery pipe.

A further object of the present invention is to provide a fuel supply system which includes an electronic control unit for controlling the fuel pump to regulate the pressure in the delivery pipe in addition to the above structure. Thus, electric power for the fuel pump can be used effectively, thereby reducing fuel consumption of the engine.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENT

Figure 11:
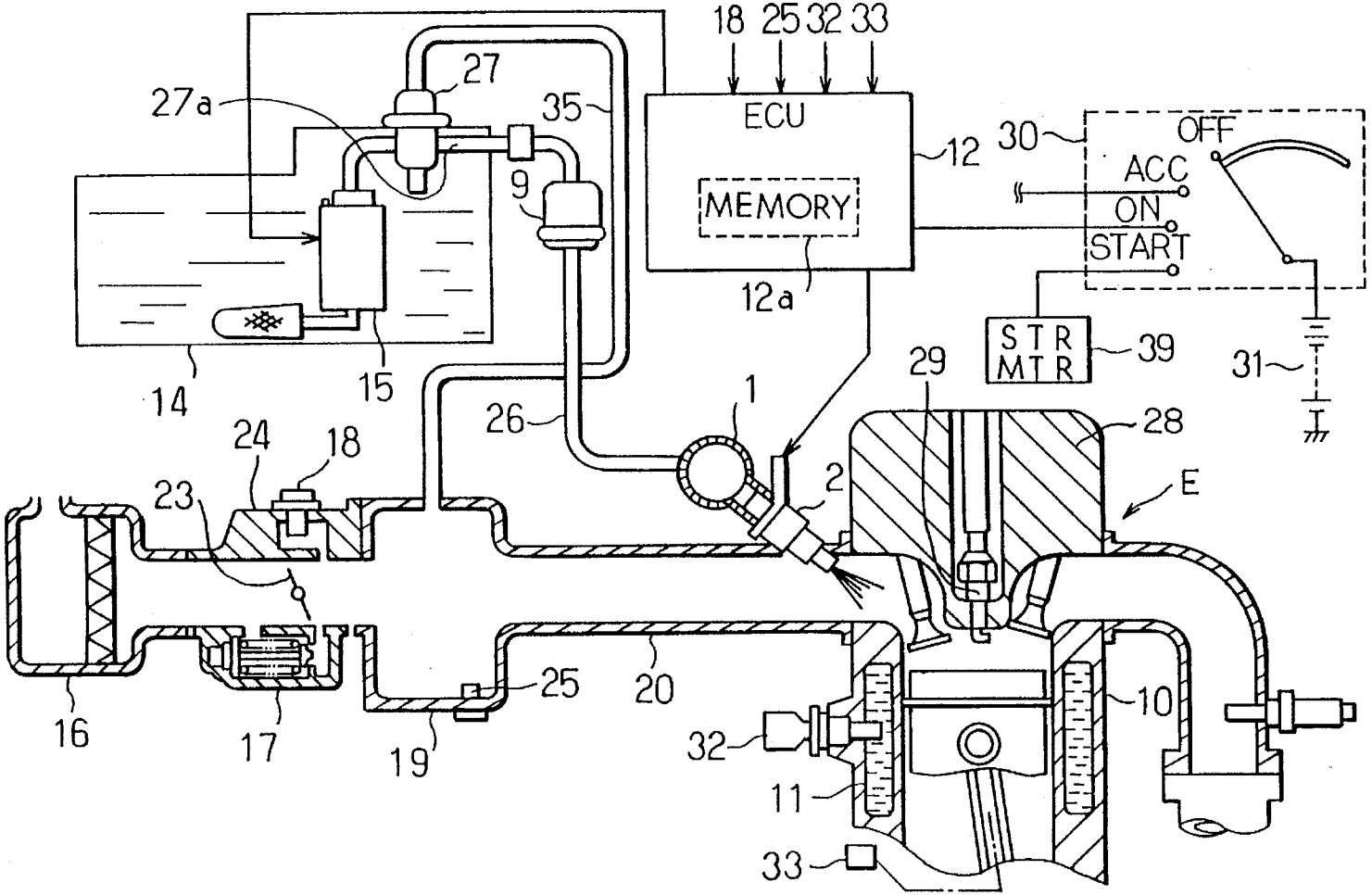
FIG. 11 is an overall structural view illustrating a fuel injection system with a system according to the present invention.

FIG. 11 is an overall structural view illustrating a fuel injection system for a vehicle. In an internal combustion engine having multiple cylinders E, air-intake pipes 20 are connected to an engine body 10. A throttle body 24, which has a throttle valve 23 operated by an accelerator (not shown), is connected to the air-intake pipes 20 at an upstream portion thereof. A surge tank 19 is disposed at a downstream portion of the throttle valve 23. An intake-air temperature sensor 25 is disposed in the surge tank 19, and an ISC (idle speed control) valve 17 and an intake-air pressure sensor 18 are disposed in the throttle body 24. The intake air temperature sensor 25 detects the temperature of air flowing through the intake-air pipe, the ISC valve 17 controls the quantity of air bypassing the throttle valve 23, and the intake-air pressure sensor 18 detects the pressure of the air flowing through the intake-air pipe. Injectors 2 are disposed respectively at the most down stream portions of the air-intake pipes 20 to supply fuel to respective cylinders of the engine E. An air cleaner 16 is also connected to the throttle body 24 at an upstream portion thereof. Spark plugs 29 for the respective engine cylinders are disposed on a cylinder head 28 of the engine body 10. The engine body 10 has a cylinder block 11 to which an engine-cooling-water temperature sensor 32 is inserted. A rotational angle sensor 33 is installed into the crank shaft (not shown) of the engine E to generate a signal at every given crank angle.

A starter motor 39 is connected to a battery 31 through a key switch 30. The starter 39 drives the crank shaft of the engine E when the key switch 30 is operated to close and electric power is supplied from the battery 31 to the starter 39. The key switch 30 has four key positions: OFF, ACC, ON and START. When the switch 30 is turned from the position OFF to the position ACC by a key (not shown), electric power is supplied to head lights, a radio or other accessories from the battery 31. When the key switch 30 is turned to the on position, electric power is supplied from the battery to an electronic control unit to be described later. When the key switch is turned to the position START, the starter 39 is energized as mentioned before.

In a fuel supplying system of the engine E, a fuel pump 15 is disposed in a fuel tank 14 to supply the fuel under pressure. A fuel pipe 26 is connected to the fuel pump 15 and a pressure regulator 27 is disposed in the fuel pipe at a portion close to the fuel tank 14. The pressure regulator 27 relieves excessive fuel pressure. A delivery pipe 1 is connected to a fuel filter 9 through the fuel pipe 26 and stores fuel temporarily and distributes the fuel to the respective injectors 2. A vacuum pipe 35 is connected between the pressure regulator 27 and the surge tank 19 to supply an intake air to the pressure regulator 27. Fuel pressure in the delivery pipe 1 is controlled to a given value by the pressure regulator 27. The pressure regulator 27 is disposed between the fuel pump 15 and the delivery pipe 1, and a return pipe, which is directly connected to the delivery pipe 1, is omitted.

An electronic control unit (hereinafter referred to as the ECU) 12 is powered by the battery 31 and is connected to the intake-air temperature sensor 25, the intake-air pressure sensor 18, the cooling-water-temperature sensor 32, the rotational angle sensor 33 to obtain data including intake air temperature TA, intake-air pressure Pm, cooling water temperature TW and engine rotational speed Ne. The ECU has a memory **12*a* for storing data received from those sensors and various processed data, and sends drive signals to the injectors 2 and the fuel pump 15**.

The above-described system is called an in-tank return type, because the pressure regulator 27 is disposed in the fuel tank 14 to return an excessive fuel to the fuel tank 14. However, another system, in which the fuel pressure in the delivery pipe 1 is controlled according to a signal supplied to the fuel pump 15, can be also adopted in the present invention.

Figure 1:
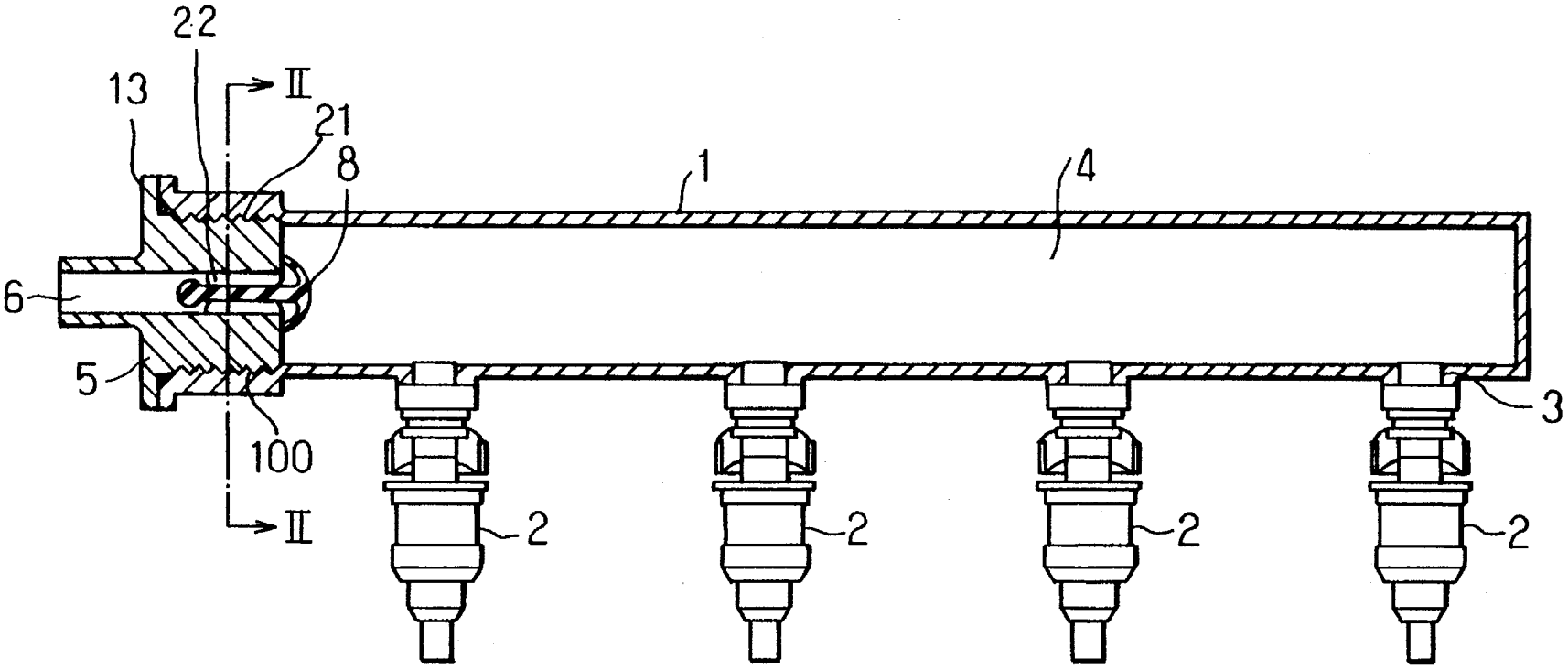
FIG. 1 is a cross-sectional front view illustrating a main part of a system according to a first embodiment of the present invention.
Figure 2:
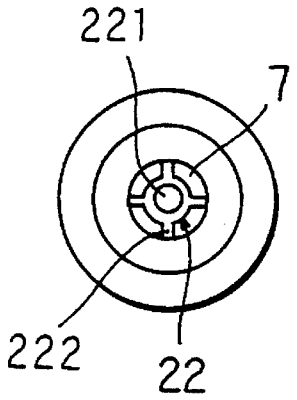
FIG. 2 is a cross-sectional view illustrating a portion of the system cut along a line II—II in FIG. 1.
Figure 3:
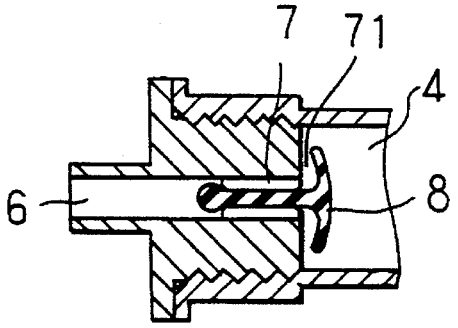
FIG. 3 is a cross-sectional front view of the main part in a valve opening condition according to the first embodiment of the present invention.

A first embodiment of the present invention is now described with reference to FIG. 1 through FIG. 3. FIG. 1 shows a cross-sectional view of a delivery pipe 1. The delivery pipe 1 has a cylindrical portion on which a plurality of outlets 3 are formed to have injectors 2 respectively connected thereto. An inlet 100 is formed at one end of the cylindrical portion to receive an inlet pipe 5 which is fastened by screw threads 21 formed around the inlet pipe 5 and an inner periphery of the inlet 100. A seal ring 13 is inserted between the inlet 100 of the delivery pipe 1 and the inlet pipe 5. A check valve 8 is disposed to cover the inlet 6. The check valve 8 is made of rubber and has a stem which is inserted into a guide hole 221 of a guide 22. The guide 22 has radially extending ribs 222 formed around the guide hole 221 and provides four fuel passages 7 between the ribs 222 and the inlet pipe 5 as shown in FIG. 2 and FIG. 3. When the check valve 8 opens, the fuel passages 7 and the inlet pipe 5 are connected through a gap 71 to the inside 4 of the delivery pipe 1 as shown in FIG. 3. This structure allows fuel to flow into the inside of the delivery pipe 1 from the fuel pump 15 and restricts the fuel flowing to the fuel pump 15 from the delivery pipe 1.

While the engine is running, the fuel is supplied through the inlet pipe 5, the fuel passages 7, the check valve 8 and the inside 4 of delivery pipe 1, and delivered to the injectors 2 through the outlets 3 of the delivery pipe 1. When the engine stops or when the injectors 2 stop fuel injection due to engine deceleration or else the fuel supply stops, the fuel vapor in the delivery pipe 1 is heated by the engine and the pressure therein becomes higher than the pressure in a passage connected to the fuel pump as the fuel vapor expands, even if the amount of the vapor is small, thereby closing the check valve 8. Since the delivery pipe 1 is sealed by the check valve 8, generation of the fuel vapor is suppressed by the increased pressure thereafter.

The above function of suppressing fuel vapor is more useful to an automobile when the engine is stopped after a long drive. The engine temperature continues to rise even after the engine stops because neither the cooling water circulates to cool the engine nor the cooling air is supplied to radiator. therefore the fuel vapor, which causes engine troubles, may be otherwise generated in this condition.

Figure 4:
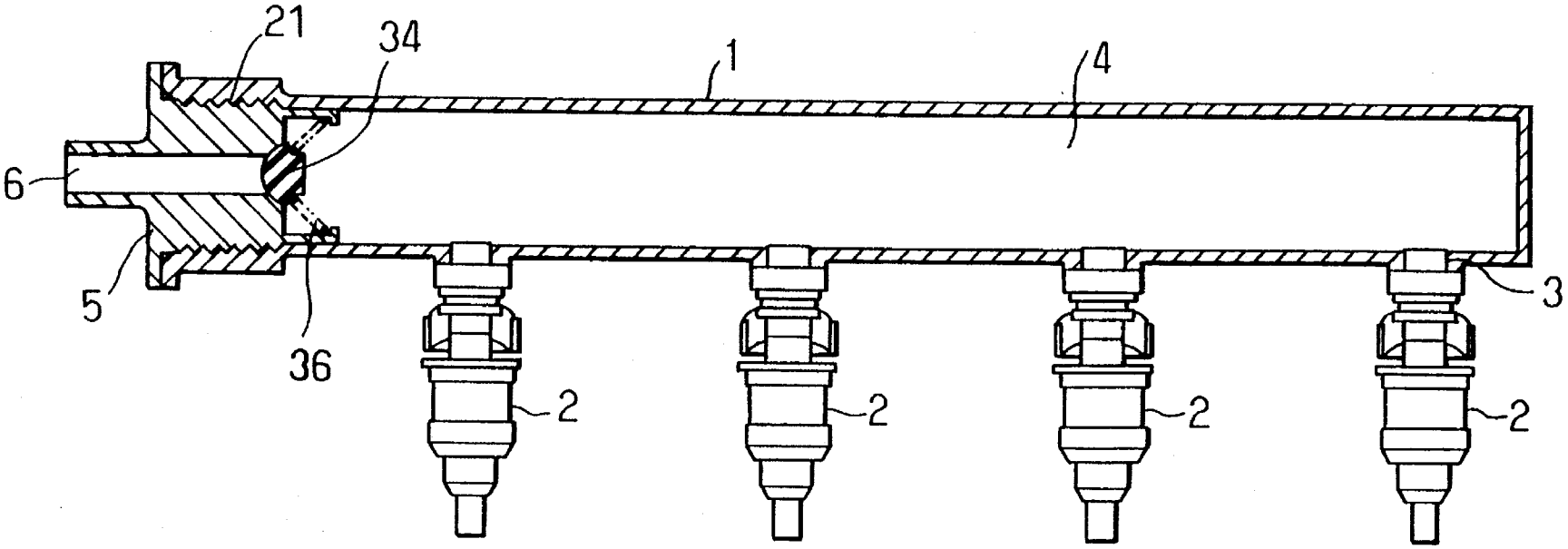
FIG. 4 is a cross-sectional front view illustrating a main part of a system according to a second embodiment of the present invention.

A second embodiment is described with reference to FIG. 4. A check valve in this embodiment is composed of a valve body 34 and a spring 36 which sets a valve opening pressure. The spring 36 is made of resilient material or shape memory alloy.

While the engine is running, the fuel is supplied through the inlet 6 of the inlet pipe 5. When the fuel pressure reaches a predetermined value, the fuel compresses the spring 36 and opens the valve body 34 and flows into the inside 4 of the delivery pipe 1. Then, the fuel is delivered to the injectors 2 through the outlets 3.

When the engine stops or when the injectors 2 stop fuel injection due to engine deceleration or else, the fuel supply stops and the pressure in the inlet of the inlet pipe 5 decreases so that the valve body 34 is closed by the spring 36 and the delivery pipe is sealed. Since fuel vapor in the inside 4 of the delivery pipe 1 is heated by the engine and the pressure therein becomes higher, generation of the fuel vapor is suppressed by the increased pressure. If the valve body is made of shape memory alloy, the sealing effect increases and higher pressure can be obtained and generation of the fuel vapor is more effectively suppressed.

Figure 6:
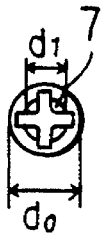
FIG. 6 is a cross-sectional view illustrating a portion of the system cut along a line VI—VI in FIG. 5.
Figure 5:
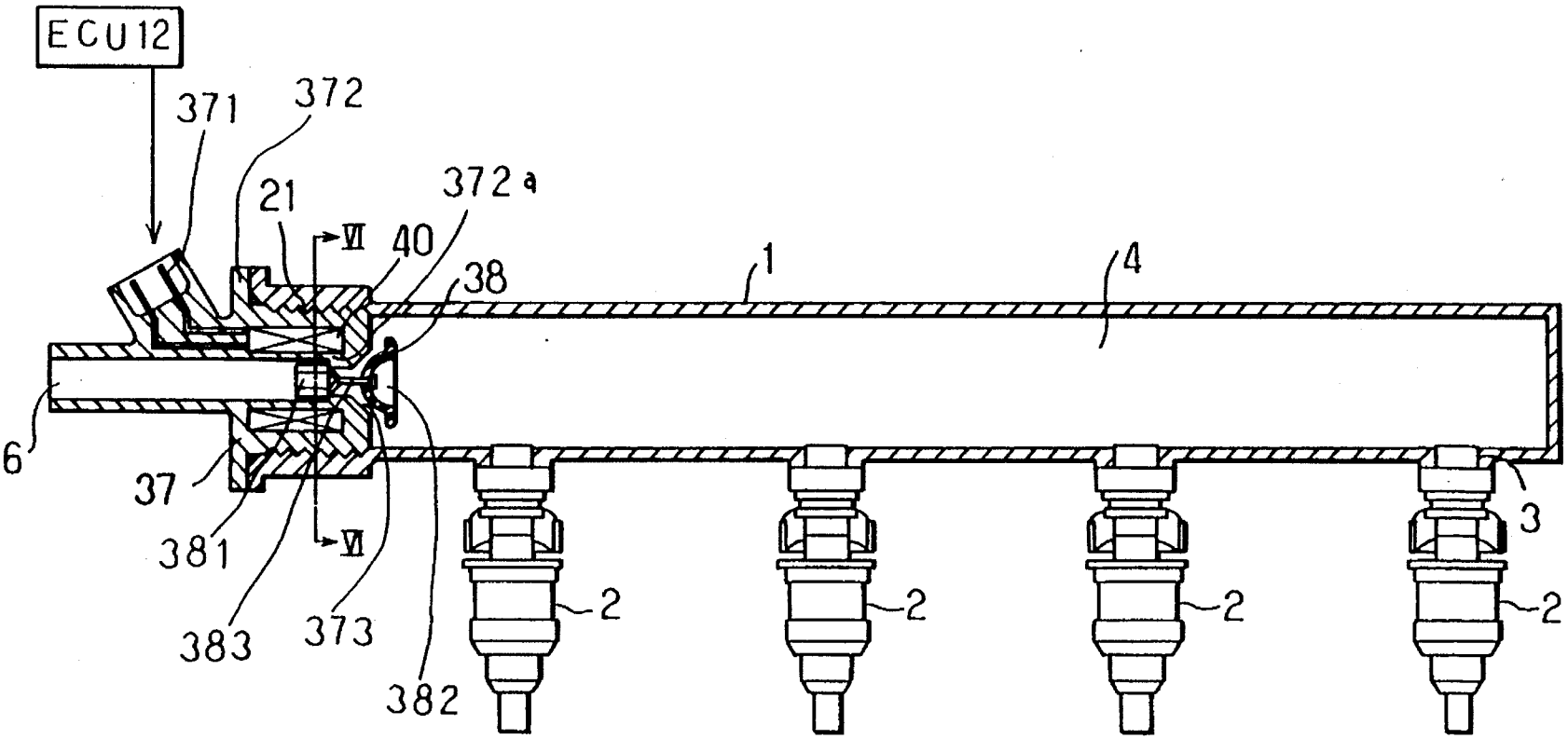
FIG. 5 is a cross-sectional front view illustrating a main part of a system according to a third embodiment of the present invention.

A third embodiment of the present invention is described with reference to FIG. 5 and FIG. 6. The third embodiment has an electro-magnetic valve 37 which is secured to the inlet of the delivery pipe 1 by threads 21 as shown in FIG. 5.

The electro-magnetic pipe 37 has a connecter 371 to which a fuel-supply-stop signal is sent from the ECU 12. A solenoid coil 40 is molded and inserted into a casing 372, and is connected to the connecter 371. The casing 372 has a valve seat portion 373 which receives a valve 38 (to be described later). The fuel passages 7 connecting the inside 4 of the delivery pipe 1 and the inlet 6 are formed in the casing 372. A step portion **372*a* is formed on a portion of the delivery pipe which has an opening of a smaller diameter d1 as compared to the diameter d0 of the inlet 6 as shown in FIG. 6. The valve 38 is composed of an armature 381, a valve body 382 and a bar 383 connecting these two members. The armature 381 has a cross member as shown in FIG. 6 and the fuel flows through passages 7 formed between the armature 381 and the casing 372**.

While the engine is running, the fuel flows through the inlet 6, the fuel passages 7 and presses on the valve 38 to open toward inside 4 of the delivery valve 1 until the armature 381 abuts the step portion **372*a*. Then, the fuel flows into the inside 4 of the delivery pipe 1 and is delivered to the injectors 2 through the outlets 3 of the delivery pipe 1**.

When the engine stops or when the injector 2 stop fuel injection for the deceleration-fuel-cut or else the solenoid coil 40 of the electro-magnetic valve 37 is energized by the ECU 12 and the armature 381 is moved toward the inlet 6, the valve member 382 closes the seat 373, thereby sealing the inside 4 of the delivery pipe 1. Although the fuel in the inside 4 of the delivery pipe 1 is heated by the engine and its temperature rises for a while after the engine stops, the pressure rises sharply as fuel vapor is generated. Accordingly, the generation of the fuel vapor is suppressed substantially. In a preferred embodiment, the electro-magnetic valve 37 is deenergized ten seconds after it is energized (the operation time may be selected from a period between few seconds and several minutes according to the engine conditions). The valve 38 is pressed by the pressure in the inside 4 of the delivery pipe 1 to keep it closed thereafter.

Figure 14:
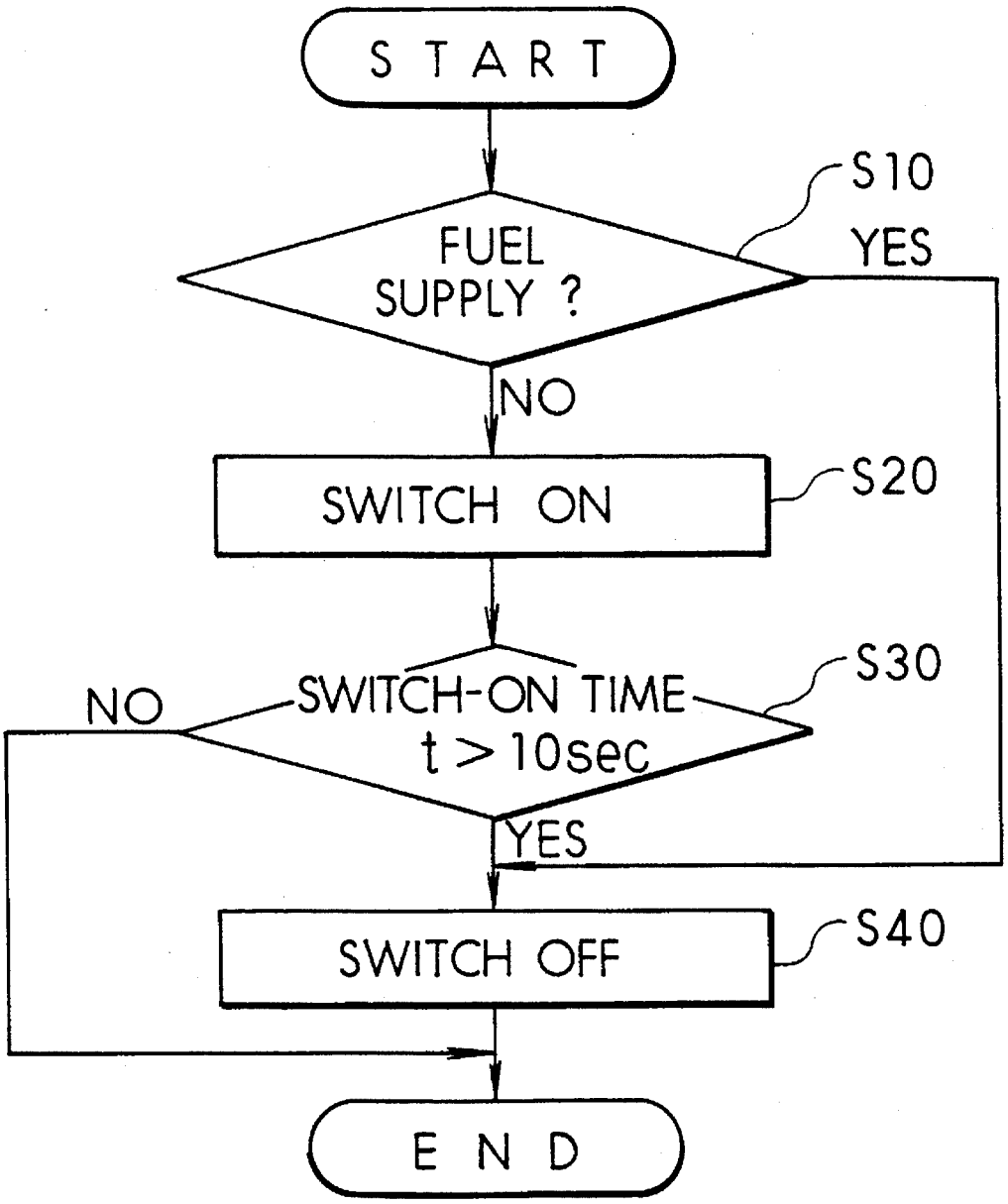
FIG. 14 is a flow chart showing an operation of the system according to the third embodiment.

The above operation of the electro-magnetic valve 37 is explained with reference to a flow chart shown in FIG. 14.

The main routine is executed by the ECU 12 every given period.

When the main routine is started, whether the fuel is being supplied or not is checked (step S10). If YES, the electro-magnetic valve 37 is deenergized in step S40 (to be described later). If NO, the electro-magnetic valve 37 is energized (step S20). Then, the energized time t of the electro-magnetic valve 37 is counted and whether t>10 sec or not is checked (step S30). If YES t is greater than 10 sec, the electro-magnetic valve 37 is deenergized (step S40) and the routine is stopped. If t is not greater than 10 sec, the routine is stopped instantly.

Figure 7:
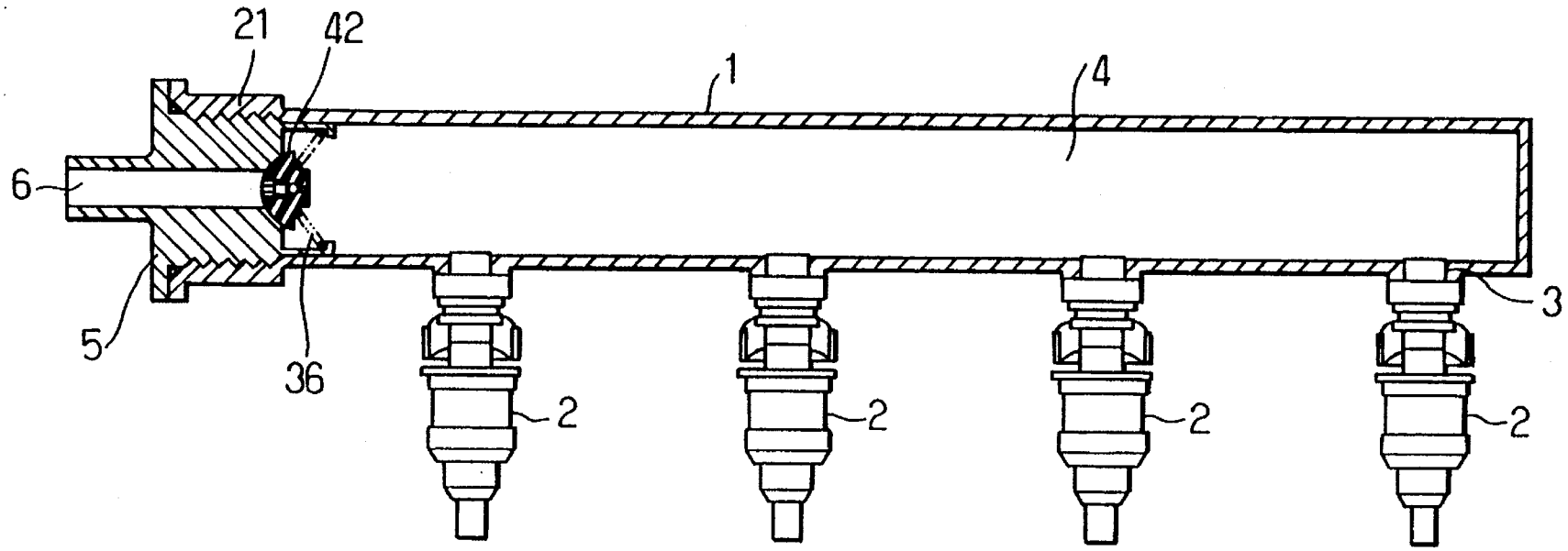
FIG. 7 is a cross-sectional front view illustrating a main part of a system according to a fourth embodiment of the present invention.
Figure 8:
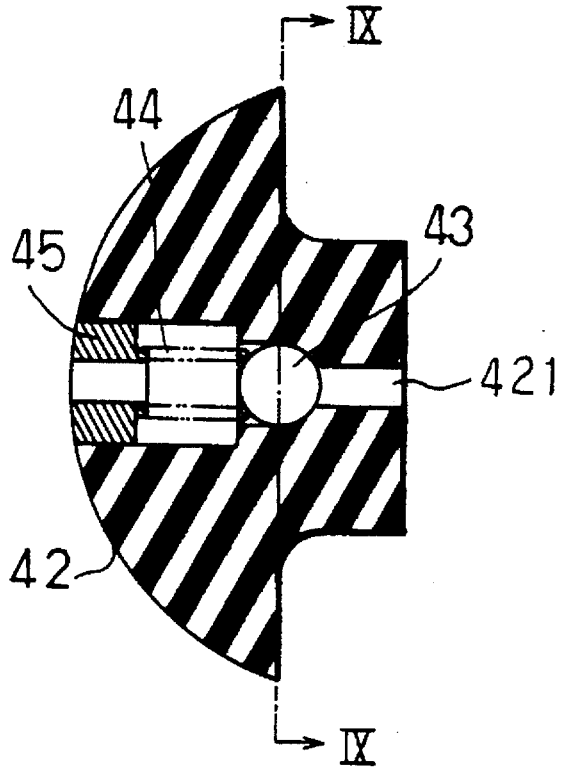
FIG. 8 is a partial cross-sectional enlarged view illustrating a check valve of the system shown in FIG. 7.

A fourth embodiment is described with reference to FIG. 7 through FIG. 9. The fourth embodiment has a pressure relief valve 43, a relief valve spring 44 and a disk member 45 in a valve body 42 of the check valve as shown in FIG. 7 and FIG. 8. The pressure relief valve 43 relieves the pressure in the delivery pipe toward the fuel pump.

The pressure relief valve 43 is made of a spherical member and the relief valve spring 44 has a coil portion, which has a diameter smaller than the diameter of the pressure relief valve to receive the relief valve 43. The relief valve spring 44 biases the relief valve 43 toward the inside of the delivery pipe 1.

Figure 9:
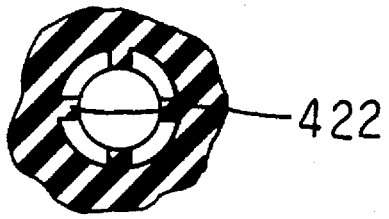
FIG. 9 is a cross-sectional view illustrating a portion of the check valve cut along a line IX—IX in FIG. 8.

The valve body 42 has radially extending ribs 422, which extend toward the center thereof until they come in contact with the relief valve 43 as shown in FIG. 9. The outer diameter of the relief valve 43 is greater than the diameter of an oil passage 421 of the valve body 42.

The operation of the fourth embodiment is described next.

When the fuel and vapor fill in the inside 4 of the delivery pipe 1 and the pressure in the delivery pipe 1 rises as it is heated, the relief valve 43 moves toward the inlet 6 against the relief valve spring 44 and opens the fuel passage 421, thereby relieving excessive pressure from the inside 4 of the delivery pipe 1 through the oil passage 421, the valve body 42 and the inlet 6 of the inlet pipe 5 toward the fuel pump.

Because the relief valve 43 is disposed in the valve body 42 in this embodiment, an excessive pressure due to the fuel expansion in the inside 4 of the delivery pipe 1 can be prevented by a simple structure. However, the relief valve can be disposed outside of the valve body if it is connected in parallel with the check valve. The relief valve may be replaced by another member such as a pressure control valve.

Figure 13:
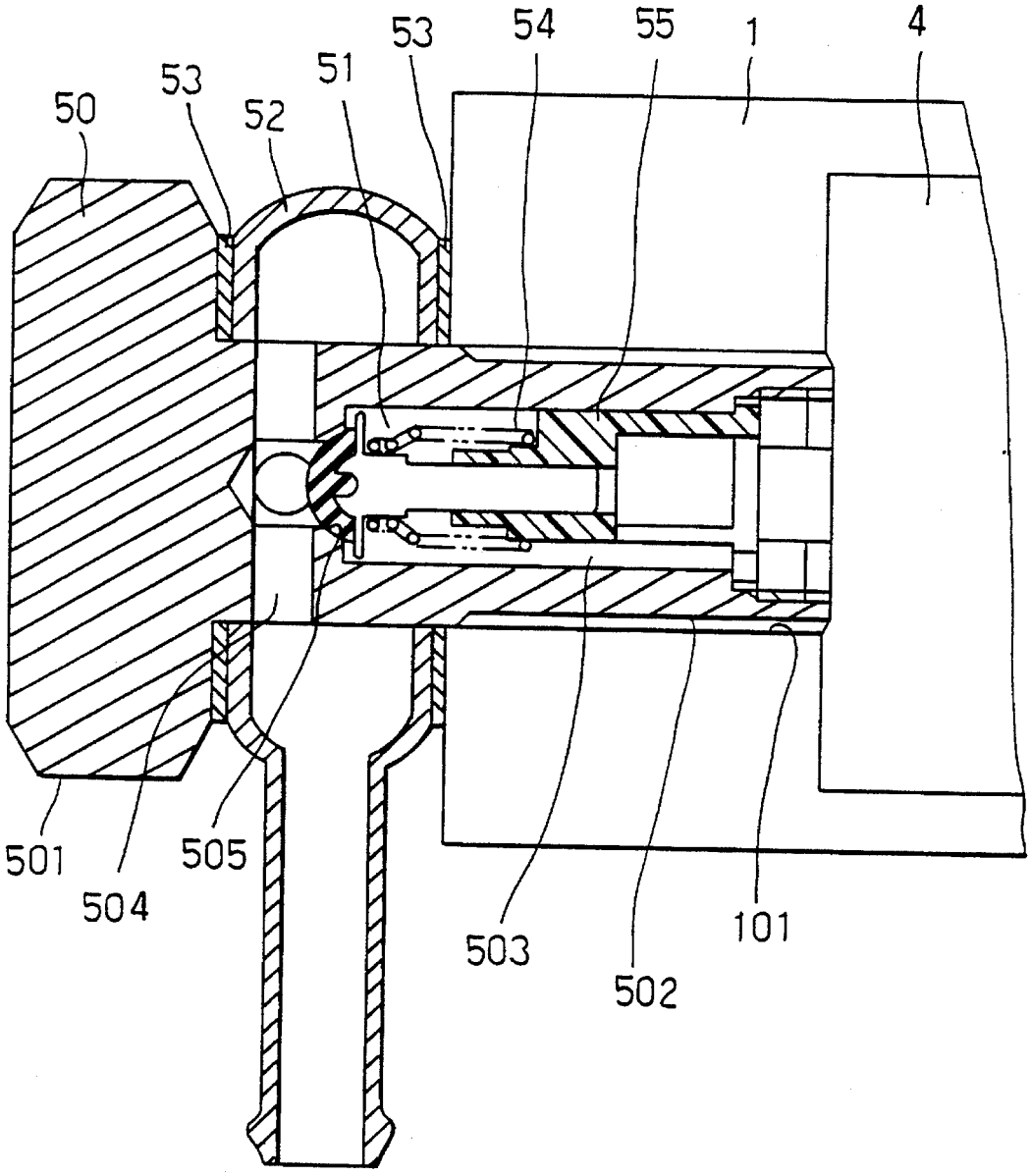
FIG. 13 is a cross-sectional front view illustrating a main part of a system according to a fifth embodiment.

A fifth embodiment is illustrated in FIG. 13, where a connecting pipe 52, which is a fuel supplying pipe, and the delivery pipe 1 are fastened together by a hollow screw 50 and a check valve 51 is disposed in a hollow portion of the screw 50. Two sealing washers 53 are disposed between the hollow screw 50 and the connecting pipe 52 and between the connecting pipe 52 and the delivery pipe 1 respectively. A head portion 501 of the hollow screw 50 is formed to facilitate assembling work by a wrench. When assembled, the head is wrenched tight to form an interference between the seal washer 53 and the delivery pipe 1. A male screw 502 is formed on a portion of the hollow screw 50 opposite the head portion 501 and is screwed into a female screw 101 of the delivery pipe 1.

An axial fuel passage 503 is formed along the axis of the hollow screw 50 and fuel passages 504 are formed to extend radially from the center in the hollow portion. Both passages are interconnected in the hollow screw 50.

A dome-shaped seat portion 505 is formed at a central portion of the cross fuel passage 503 and a seat member 55 is inserted in the hollow portion close to the delivery pipe 1.

A check valve 51 is inserted in the axial fuel passage 503 and a valve spring 54 is disposed between the seat member 55 and the check valve 51. The valve spring 54 biases the check valve 51 against the seat portion 505.

When the fuel is supplied by the fuel pump, it flows from the connecting pipe 52 through the axial fuel passage 504 and presses the check valve 51 open, and further flows into the inside 4 of the delivery pipe 1. When a pressure difference between the inside 4 of the delivery pipe 1 and the connecting pipe 53 is generated due to some trouble, such as fuel stop or the like, the check valve closes, thereby preventing generation of the fuel vapor. The operation in such case is the same as the operation of the previous embodiments.

In the fifth embodiment, since the connecting pipe 52 (which is a fuel supplying pipe) and the delivery pipe 1 are fastened by a hollow screw 50 which accommodates the check valve 51 therein, a simple, compact and detachable fuel supplying apparatus is provided.

The valve of the embodiments 1, 2, 4 and 5, which restricts the fuel flow from the delivery pipe to the fuel pump, is disposed at an opening end of the delivery pipe 1. In these embodiments, the pressure in the inside 4 of the delivery pipe 1 changes when the injectors 2 operate.

If the check valve shown in FIG. 7 is not provided, pressure waves caused by the pressure change reach an outlet 27*a* of the pressure regulator 27 through the fuel pipe 26 (see FIG. 11).

The pressure waves are reflected from the fuel pump 15 and return to the inside 4 of the delivery pipe 1 through the fuel pipe 26. If the wave transmitting cycle matches a natural oscillation frequency of the fuel supply structure including the fuel pipe, the pressure wave is amplified and causes harsh noise. The check valves of the above embodiments prevent the transmission of the pressure wave and, therefore, prevent generation of such harsh noise.

A sixth embodiment is described with reference to FIG. 10 next. In this embodiment, a valve body 341 which has a small orifice 46 connecting the inlet 6 and the inside 4 of the delivery pipe 1 is used instead of the valve body 42 shown in FIG. 7 (fourth embodiment).

The orifice 46 has a diameter $\phi d$ which is much smaller than the diameter $\phi D_0$ of the inside of the delivery pipe and the diameter $\phi D_1$ of the inlet 6.

The above structure allows the fuel supplied to the delivery pipe freely and restricts the fuel returning from the delivery pipe to the fuel pump.

Figure 10:
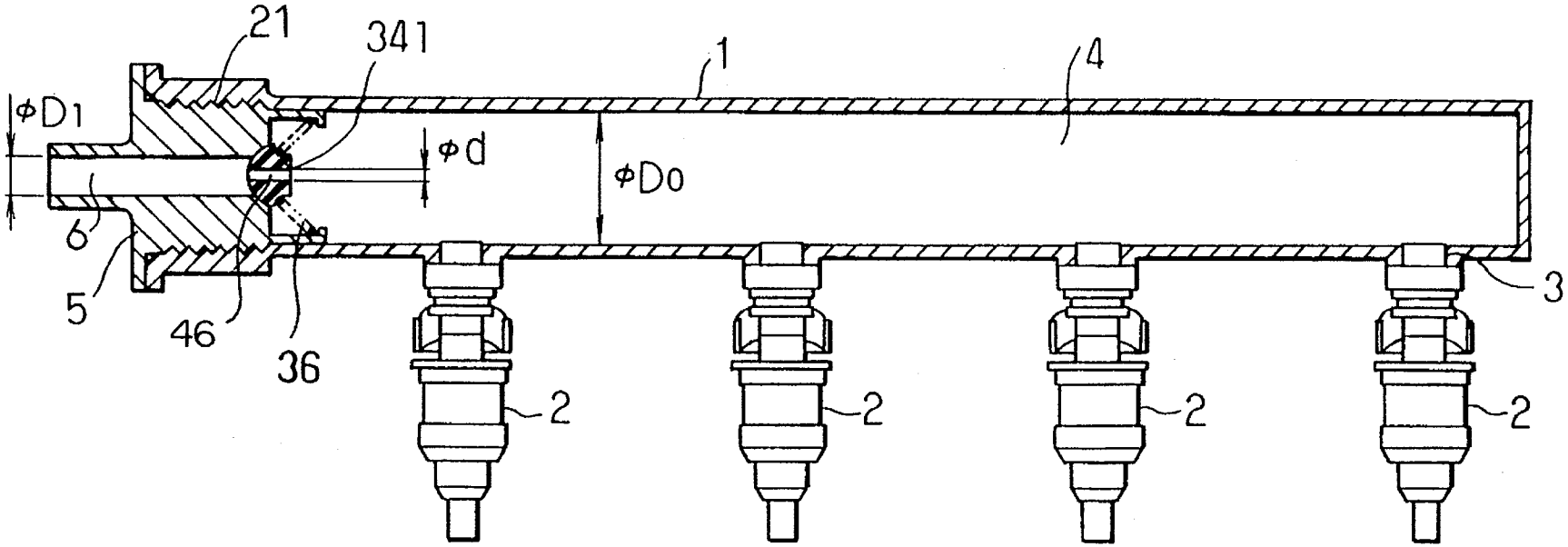
FIG. 10 is a cross-sectional view illustrating a main part of a system according to a sixth embodiment of the present invention.

In the fifth embodiment shown in FIG. 10, since the valve body 341 has a small orifice 46, the pressure in the inside 4 of the delivery pipe 1 can be relieved gradually through the orifice 46 while the check valve is closed. Therefore, an excessive pressure due to the fuel expansion in the inside 4 of the delivery pipe 1 can be prevented by a simple structure.

Figure 12:
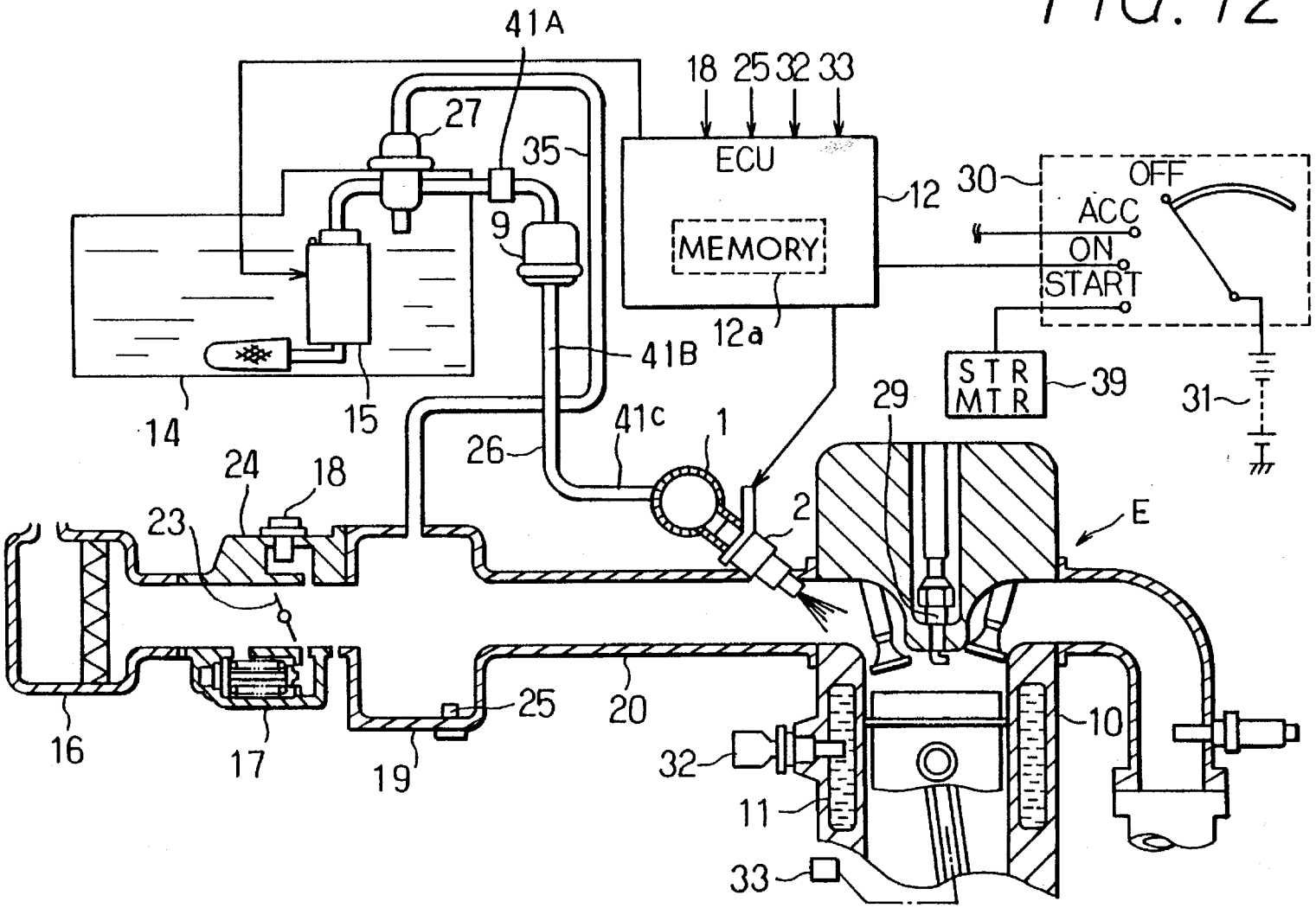
FIG. 12 is an overall structural view illustrating another fuel injection system with a system according to the present invention.

Another embodiment of the present invention is illustrated in FIG. 12.

A pressure regulator is disposed between the fuel supply pipe in the fuel tank and returns excessive fuel to the tank, and a check valve 41A is disposed at a downstream portion of the pressure regulator. The check valve 41A closes the fuel pipe 26 when the engine stops.

When the engine stops, the temperature of the delivery pipe 1 becomes high enough to generate the fuel vapor. However, since the valve 41A closes the fuel pipe, the fuel pressure in the delivery pipe increases as the temperature rises and further generation of the fuel vapor is suppressed. Since the valve 41A is disposed down stream of the pressure regulator 27, only a small part of the fuel pipe between the pressure regulator 27 and the delivery pipe 1 is required to have a high-pressure resistance, thereby providing a simple fuel supply structure.

The above structure prevents the pressure wave from transmitting to the fuel pump, thereby preventing the resonation of the fuel supply structure and, accordingly, generation of harsh noise. The check valve 41A can be disposed in the delivery pipe as the check valves of the first through five embodiments.

The check valve can be disposed st a downstream portion of the fuel filter as indicated by a reference numeral 41B in FIG. 12. Since the fuel filter 9 is not exposed to a high pressure in this case, deformation or deterioration of the filter element is prevented with a simple structure. The check valve can be disposed at a position indicated by a reference numeral 41C, that is, immediately upstream of the delivery pipe 1. In this case, the fuel pipe is not exposed to high pressure and remains as it is without additional reinforcement, resulting in a simple structure.

When the check valve is disposed outside the delivery pipe 1, members to be exposed to the high pressure decreases as the fuel pipe is disposed at more downstream portion of the fuel pipe. The check valve should be located where the associated fuel supply structure does not resonate at the pressure wave frequency.

Decreasing of the pressure waves and the prevention of the fuel vapor are different with the check valves and described as follows.

If the valve restricts the fuel flow in a direction from the downstream portion to the upstream portion as compared with the fuel flow from the upstream portion to the downstream portion, the valve can decrease transmission of the pressure waves. Such valve may be a valve which opens or closes in response to a pressure difference. A check valve having an orifice which connects the upstream and the downstream portions thereof is also available to such valve.

A valve can prevent generation of the fuel vapor if it interrupts fuel flow from the upstream portion to the down stream portion thereof. Such valve may be a valve which opens or closes in response to a pressure difference.

A check valve having a valve disposed in a passage which connects both sides thereof in parallel with the check valve is effective to prevent generation of excessive pressure. A relief valve formed integrally with the check valve is available to one of such valve. An orifice is useful if it is formed integrally with the check valve and disposed in a passage connecting upstream and downstream portions of the check valve.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. A fuel supply system for an internal combustion engine comprising:

a fuel tank;

a fuel pump for supplying fuel from said fuel tank;

a fuel passage connected to said fuel pump that supplies fuel from said fuel tank to said internal combustion engine;

an injector for supplying fuel to said internal combustion engine;

a fuel-return-pipe-less delivery pipe connected to said fuel passage for delivering fuel from said fuel passage to said injector, said fuel-return-pipe-less delivery pipe having a hollowing member to which said injector is directly connected; and a check valve disposed at one end of said hollow member of said fuel-return-pipe-less delivery pipe and connected between said fuel passage and said fuel-return-pipe-less delivery pipe for interrupting fuel flow from said fuel-return-pipe-less delivery pipe to said fuel passage.

2. A fuel supply system for an internal combustion engine comprising:

a fuel tank;

a fuel pump for supplying fuel from said fuel tank;

a fuel passage connected to said fuel pump that supplies fuel from said fuel tank to said internal combustion engine;

an injector for supplying fuel to said internal combustion engine;

a fuel-return-pipe-less delivery pipe having a longitudinal hollow member supporting said injector and connected to said fuel passage for delivering fuel from said fuel passage to said injector; and fuel restricting means disposed at one end of said hollow member and connected between said fuel passage and said fuel-return-pipe-less delivery pipe for restricting fuel flow from said fuel-return-pipe-less delivery pipe to said fuel passage.

3. A fuel supply system for an internal combustion engine claimed in claim 2, wherein said fuel restricting means comprises a valve operable in response to a difference between a pressure in said fuel pump and a pressure in said fuel-return-pipe-less delivery pipe.

4. A fuel supply system for an internal combustion engine claimed in claim 3, wherein said valve comprises a check valve.

5. A fuel supply system for an internal combustion engine claimed in claim 4 further comprising a fuel filter disposed in said fuel passage at an upstream portion relative to said check valve.

6. A fuel supply system for an internal combustion engine claimed in claim 2, said fuel-return-pipe-less delivery pipe further comprises a hollow screw fixed to said inlet and said check valve is disposed in said hollow screw.

7. A fuel supply system for an internal combustion engine claimed in claim 2, further comprising a fuel pressure regulator disposed in said fuel tank for regulating fuel pressure in said fuel-return-pipe-less delivery pipe.

8. A fuel supply system for an internal combustion engine claimed in claim 2, further comprising an electronic control unit for controlling said fuel pump to regulate said pressure supplied to said fuel-return-pipe-less delivery pipe.

9. A fuel supply system for an internal combustion engine claimed in claim 4, further comprising a passage to said fuel passage from said fuel-return-pipe-less delivery pipe for relieving pressure in said fuel-return-pipe-less delivery pipe.

10. A fuel supply system for an internal combustion engine claimed in claim 9, wherein said passage for relieving pressure comprises an orifice formed in said check valve.

11. A fuel supply system for an internal combustion engine claimed in claim 2, wherein said fuel restricting means closes if said fuel pump stops fuel supply to said fuel-return-pipe-less delivery pipe.

12. A fuel supply system for an internal combustion engine claimed in claim 11 further comprising means for generating an electric signal if fuel supply to said fuel-return-pipe-less delivery pipe is stopped, wherein said restricting means comprises an electric control valve controlled according to said electric signal.

13. An assembly for providing fuel to a fuel injector in a fuel supply system for an internal combustion engine including a fuel tank, a fuel pump, a fuel passage connected to said fuel pump that supplies fuel from said fuel tank to said internal combustion engine and said injector for supplying fuel to said internal combustion engine, said assembly comprising:

a fuel-return-pipe-less delivery pipe having a cylindrical portion connected to said injector and connected to said fuel passage for delivering fuel from said fuel passage to said injector; and pressure increasing means, disposed at an inlet of said cylindrical portion of said fuel-return-pipe-less delivery pipe and connected to said fuel passage, for increasing a pressure in said fuel-return-pipe-less delivery pipe to suppress generation of fuel vapor in said fuel-return-pipe-less delivery pipe if said engine stops.

14. An assembly claimed in claim 13, wherein said pressure increasing means comprises a check valve disposed inside said fuel-return-pipe-less delivery pipe.

15. An assembly claimed in claim 13, wherein said pressure increasing means comprises an electro-magnetic valve and a control unit for controlling said electro-magnetic valve.

16. A fuel supply system for an internal combustion engine comprising:

a fuel tank;

a fuel pump for supplying fuel from said fuel tank;

a fuel passage connected to said fuel pump;

an injector for supplying fuel to said internal combustion engine;

a fuel-return-pipe-less delivery pipe connected to said fuel passage for delivering fuel from said fuel passage to said injector; and a check valve disposed in an inlet of said fuel-return-pipe-less delivery pipe for restricting fuel flow from said fuel-return-pipe-less delivery pipe to said fuel passage, wherein said fuel-return-pipe-less delivery pipe comprises a hollow screw fixed to said inlet and said check valve is disposed in said hollow screw.

17. A fuel supply system for an internal combustion engine comprising:

a fuel tank;

a fuel pump for supplying fuel from said fuel tank;

a fuel passage connected to said fuel pump;

an injector for supplying fuel to said internal combustion engine;

a fuel-return-pipe-less delivery pipe connected to said fuel passage for delivering fuel from said fuel passage to said injector;

a check valve disposed between said fuel passage and said fuel-return-pipe-less delivery pipe for restricting fuel flow from said fuel-return-pipe-less delivery pipe to said fuel passage; and a passage disposed in said check valve for relieving pressure in said fuel-return-pipe-less delivery pipe.

18. A fuel supply system for an internal combustion engine comprising:

a fuel tank;

a fuel pump for supplying fuel from said fuel tank;

a fuel passage connected to said fuel pump;

an injector for supplying fuel to said internal combustion engine;

a fuel-return-pipe-less delivery pipe connected to said fuel passage for delivering fuel from said fuel passage to said injector;

an electrically operated control valve disposed between said fuel passage and said fuel-return-pipe-less delivery pipe for restricting fuel flow from said fuel-return-pipe-less delivery pipe to said fuel passage if said fuel pump stops supply fuel to said fuel-return-pipe-less delivery pipe; and means for generating an electric signal to control said control valve.

19. An assembly for providing fuel to a fuel injector in a fuel supply system for an internal combustion engine including a fuel tank, a fuel pump, a fuel passage connected to said fuel pump and said injector for supplying fuel to said internal combustion engine, said assembly comprising:

a fuel-return-pipe-less delivery pipe connected to said fuel passage for delivering fuel from said fuel passage to said injector; and pressure increasing means, connected between said fuel passage and said fuel-return-pipe-less delivery pipe, for increasing a pressure in said fuel-return-pipe-less delivery pipe to suppress generation of fuel vapor in said fuel-return-pipe-less delivery pipe if said engine stops, wherein said pressure increasing means comprises an electro-magnetic valve and a control unit for controlling said electro-magnetic valve.

* * * * *